US008569972B2

(12) United States Patent
Melanson

(10) Patent No.: US 8,569,972 B2
(45) Date of Patent: Oct. 29, 2013

(54) DIMMER OUTPUT EMULATION

(75) Inventor: John L. Melanson, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 300 days.

(21) Appl. No.: 12/858,164

(22) Filed: Aug. 17, 2010

(65) Prior Publication Data

US 2012/0043913 A1 Feb. 23, 2012

(51) Int. Cl.
*H05B 37/02* (2006.01)

(52) U.S. Cl.
USPC ..... 315/307; 315/247; 315/291

(58) Field of Classification Search
USPC ..... 315/209 R, 227 R, 246, 247, 283, 291, 315/307, 308, 360
See application file for complete search history.

(56) References Cited

U.S. PATENT DOCUMENTS

| | | | |
|---|---|---|---|
| 3,316,495 | A | 4/1967 | Sherer |
| 3,423,689 | A | 1/1969 | Miller et al. |
| 3,586,988 | A | 6/1971 | Weekes |
| 3,725,804 | A | 4/1973 | Langan |
| 4,409,476 | A | 10/1983 | Lofgren et al. |
| 4,523,128 | A | 6/1985 | Stamm |
| 4,937,728 | A | 6/1990 | Leonardi |
| 4,980,898 | A | 12/1990 | Silvian |
| 5,001,620 | A | 3/1991 | Smith |
| 5,055,746 | A | 10/1991 | Hu et al. |
| 5,109,185 | A | 4/1992 | Ball |
| 5,121,079 | A | 6/1992 | Dargatz |
| 5,264,780 | A | 11/1993 | Bruer et al. |
| 5,319,301 | A | 6/1994 | Callahan et al. |
| 5,424,932 | A | 6/1995 | Inou et al. |
| 5,430,635 | A | 7/1995 | Liu |
| 5,479,333 | A | 12/1995 | McCambridge et al. |
| 5,589,759 | A | 12/1996 | Borgato et al. |
| 5,757,635 | A | 5/1998 | Seong |
| 5,764,039 | A | 6/1998 | Choi et al. |
| 5,768,111 | A | 6/1998 | Zaitsu |
| 5,798,635 | A | 8/1998 | Hwang et al. |
| 5,912,812 | A | 6/1999 | Moriarty, Jr. |
| 5,946,206 | A | 8/1999 | Shimizu et al. |
| 5,960,207 | A | 9/1999 | Brown |

(Continued)

FOREIGN PATENT DOCUMENTS

| | | |
|---|---|---|
| DE | 19713814 | 10/1998 |
| EP | 0632679 | 1/1995 |

(Continued)

OTHER PUBLICATIONS

Mamano, Bob, "Current Sensing Solutions for Power Supply Designers", Unitrode Seminar Notes SEM1200, 1999.

(Continued)

*Primary Examiner* — James H Cho
(74) *Attorney, Agent, or Firm* — Terrile, Cannatti, Chambers & Holland, LLP; Kent B. Chambers

(57) ABSTRACT

A lighting system includes a dimmer output voltage emulator to cause a power converter interface circuit to generate an emulated dimmer output voltage. In at least one embodiment, the emulated dimmer output voltage corresponds to an actual dimmer output voltage but is unaffected by non-idealities in the dimmer output voltage, such as premature shut-down of a triac-based dimmer. By generating an emulated dimmer output voltage, the energy delivered to a load, such as a lamp, corresponds to a dimming level setting.

21 Claims, 12 Drawing Sheets

(56) References Cited

U.S. PATENT DOCUMENTS

| | | | |
|---|---|---|---|
| 5,962,989 | A | 10/1999 | Baker |
| 6,091,233 | A | 7/2000 | Hwang |
| 6,125,046 | A | 9/2000 | Jang et al. |
| 6,181,114 | B1 | 1/2001 | Hemena et al. |
| 6,229,292 | B1 | 5/2001 | Redl et al. |
| 6,343,026 | B1 | 1/2002 | Perry |
| 6,369,525 | B1 | 4/2002 | Chang et al. |
| 6,407,514 | B1 | 6/2002 | Glaser et al. |
| 6,407,515 | B1 | 6/2002 | Hesler |
| 6,469,484 | B2 | 10/2002 | L'Hermite et al. |
| 6,531,854 | B2 | 3/2003 | Hwang |
| 6,628,106 | B1 | 9/2003 | Batarseh et al. |
| 6,646,848 | B2 | 11/2003 | Yoshida et al. |
| 6,657,417 | B1 | 12/2003 | Hwang |
| 6,688,753 | B2 | 2/2004 | Calon et al. |
| 6,713,974 | B2 | 3/2004 | Patcharnik et al. |
| 6,724,174 | B1 | 4/2004 | Esteves et al. |
| 6,737,845 | B2 | 5/2004 | Hwang |
| 6,756,772 | B2 | 6/2004 | McGinnis |
| 6,858,995 | B2 | 2/2005 | Lee et al. |
| 6,900,599 | B2 | 5/2005 | Ribarich |
| 6,963,496 | B2 | 11/2005 | Bimbaud |
| 6,975,523 | B2 | 12/2005 | Kim et al. |
| 6,980,446 | B2 | 12/2005 | Simada et al. |
| 7,034,611 | B2 | 4/2006 | Oswal et al. |
| 7,072,191 | B2 | 7/2006 | Nakao et al. |
| 7,099,163 | B1 | 8/2006 | Ying |
| 7,102,902 | B1 | 9/2006 | Brown et al. |
| 7,126,288 | B2 | 10/2006 | Ribarich et al. |
| 7,180,250 | B1 | 2/2007 | Gannon |
| 7,246,919 | B2 | 7/2007 | Porchia et al. |
| 7,276,861 | B1 | 10/2007 | Shteynberg et al. |
| 7,345,458 | B2 | 3/2008 | Kanai et al. |
| 7,375,476 | B2 | 5/2008 | Walter et al. |
| 7,388,764 | B2 | 6/2008 | Huynh et al. |
| 7,394,210 | B2 | 7/2008 | Ashdown |
| 7,511,437 | B2 | 3/2009 | Lys et al. |
| 7,583,136 | B2 | 9/2009 | Pelly |
| 7,656,103 | B2 | 2/2010 | Shteynberg et al. |
| 7,667,986 | B2 | 2/2010 | Artusi et al. |
| 7,710,047 | B2 | 5/2010 | Shteynberg et al. |
| 7,719,246 | B2 | 5/2010 | Melanson |
| 7,719,248 | B1 | 5/2010 | Melanson |
| 7,733,678 | B1 | 6/2010 | Notohamiprodjo et al. |
| 7,746,043 | B2 * | 6/2010 | Melanson ..... 323/224 |
| 7,746,671 | B2 | 6/2010 | Radecker et al. |
| 7,750,738 | B2 | 7/2010 | Bach |
| 7,756,896 | B1 | 7/2010 | Feingold |
| 7,759,881 | B1 | 7/2010 | Melanson |
| 7,777,563 | B2 | 8/2010 | Midya et al. |
| 7,804,256 | B2 | 9/2010 | Melanson |
| 7,804,480 | B2 | 9/2010 | Jeon et al. |
| 7,872,427 | B2 | 1/2011 | Scianna |
| 8,102,167 | B2 | 1/2012 | Irissou et al. |
| 8,115,419 | B2 | 2/2012 | Given et al. |
| 8,169,154 | B2 | 5/2012 | Thompson et al. |
| 8,212,491 | B2 * | 7/2012 | Kost et al. ..... 315/247 |
| 8,212,492 | B2 | 7/2012 | Lam et al. |
| 8,222,832 | B2 | 7/2012 | Zheng et al. |
| 2002/0065583 | A1 | 5/2002 | Okada |
| 2003/0174520 | A1 | 9/2003 | Bimbaud |
| 2004/0004465 | A1 | 1/2004 | McGinnis |
| 2004/0105283 | A1 | 6/2004 | Schie et al. |
| 2004/0212321 | A1 | 10/2004 | Lys |
| 2005/0168492 | A1 | 8/2005 | Hekstra et al. |
| 2005/0197952 | A1 | 9/2005 | Shea et al. |
| 2005/0222881 | A1 | 10/2005 | Booker |
| 2006/0002110 | A1 | 1/2006 | Dowling |
| 2006/0022648 | A1 | 2/2006 | Ben-Yaakov et al. |
| 2006/0116898 | A1 | 6/2006 | Peterson |
| 2006/0184414 | A1 | 8/2006 | Pappas et al. |
| 2006/0214603 | A1 | 9/2006 | Oh et al. |
| 2006/0238136 | A1 | 10/2006 | Johnson, III et al. |
| 2006/0285365 | A1 | 12/2006 | Huynh et al. |
| 2007/0024213 | A1 | 2/2007 | Shteynberg et al. |
| 2007/0055564 | A1 | 3/2007 | Fourman |
| 2007/0124615 | A1 | 5/2007 | Orr |
| 2007/0126656 | A1 | 6/2007 | Huang et al. |
| 2007/0182338 | A1 | 8/2007 | Shteynberg |
| 2007/0182347 | A1 | 8/2007 | Shteynberg |
| 2007/0285031 | A1 | 12/2007 | Shteynberg et al. |
| 2008/0012502 | A1 | 1/2008 | Lys |
| 2008/0027841 | A1 | 1/2008 | Eder |
| 2008/0043504 | A1 | 2/2008 | Ye et al. |
| 2008/0054815 | A1 | 3/2008 | Kotikalapoodi et al. |
| 2008/0116818 | A1 | 5/2008 | Shteynberg et al. |
| 2008/0130322 | A1 | 6/2008 | Artusi et al. |
| 2008/0130336 | A1 | 6/2008 | Taguchi |
| 2008/0150433 | A1 | 6/2008 | Tsuchida et al. |
| 2008/0154679 | A1 | 6/2008 | Wade |
| 2008/0174291 | A1 | 7/2008 | Hansson et al. |
| 2008/0175029 | A1 | 7/2008 | Jung et al. |
| 2008/0205103 | A1 | 8/2008 | Sutardja et al. |
| 2008/0224629 | A1 | 9/2008 | Melanson |
| 2008/0224633 | A1 | 9/2008 | Melanson |
| 2008/0224636 | A1 | 9/2008 | Melanson |
| 2008/0232141 | A1 | 9/2008 | Artusi et al. |
| 2008/0239764 | A1 | 10/2008 | Jacques et al. |
| 2009/0067204 | A1 | 3/2009 | Ye et al. |
| 2009/0070188 | A1 | 3/2009 | Scott et al. |
| 2009/0174479 | A1 | 7/2009 | Yan et al. |
| 2009/0195186 | A1 | 8/2009 | Guest et al. |
| 2009/0284182 | A1 | 11/2009 | Cencur |
| 2010/0002480 | A1 | 1/2010 | Huynh et al. |
| 2010/0013405 | A1 | 1/2010 | Thompson et al. |
| 2010/0013409 | A1 | 1/2010 | Quek et al. |
| 2010/0141317 | A1 | 6/2010 | Szajnowski |
| 2010/0164406 | A1 | 7/2010 | Kost et al. |
| 2010/0213859 | A1 | 8/2010 | Shteynberg |
| 2010/0244726 | A1 | 9/2010 | Melanson |
| 2011/0043133 | A1 | 2/2011 | Van Laanen et al. |
| 2011/0121754 | A1 | 5/2011 | Shteynberg |
| 2011/0266968 | A1 | 11/2011 | Bordin et al. |

FOREIGN PATENT DOCUMENTS

| | | | |
|---|---|---|---|
| EP | 0838791 | | 4/1998 |
| EP | 1164819 | | 12/2001 |
| EP | 1460775 | | 9/2004 |
| EP | 2257124 | A1 | 1/2010 |
| EP | 2204905 | A1 | 7/2010 |
| EP | 2232949 | | 9/2010 |
| EP | 2257124 | A1 | 12/2010 |
| GB | 2069269 | A | 8/1981 |
| JP | 2008053181 | A | 3/2008 |
| WO | WO9725836 | | 7/1997 |
| WO | 01/15316 | A1 | 1/2001 |
| WO | 02/15386 | A2 | 2/2002 |
| WO | 02096162 | | 11/2002 |
| WO | WO2006013557 | | 2/2006 |
| WO | 2006079937 | | 8/2006 |
| WO | 2008029108 | | 3/2008 |
| WO | WO2008072160 | | 6/2008 |
| WO | WO2008152838 | | 12/2008 |
| WO | 2010011971 | A1 | 1/2010 |
| WO | WO2010011971 | A1 | 1/2010 |
| WO | 2010035155 | A2 | 4/2010 |
| WO | 2011008635 | A1 | 1/2011 |

OTHER PUBLICATIONS http://toolbarpdf.com/docs/functions-and-features-of-inverters.html printed on Jan. 20, 2011.

Combined Search and Examination Report issued in corresponding Great Britain Application No. GB1112860.0, mailed Dec. 20, 2011.

Texas Instruments, Interleaving Continuous Conduction Mode PFC Controller, UCC28070, SLUS794C, Nov., 2007, revised Jun., 2009, Texas Instruments, Dallas TX.

Azoteq, IQS17 Family, IQ Switch—ProxSense Series, Touch Sensor, Load Control and User Interface, IQS17 Datasheet V2.00.doc, Jan. 2007, pp. 1-51, Azoteq (Pty) Ltd., Paarl, Western Cape, Republic of South Africa.

Chan, Samuel, et al, Design and Implementation of Dimmable Electronic Ballast Based on Integrated Inductor, IEEE Transactions on

(56) References Cited

OTHER PUBLICATIONS

Power Electronics, vol. 22, No. 1, Jan. 2007, pp. 291-300, Dept. of Electron. Eng., City Univ. of Hong Kong.

Rand, Dustin, et al, Issues, Models and Solutions for Triac Modulated Phase Dimming of LED Lamps, Power Electronics Specialists Conference, 2007. PESC 2007. IEEE, Jun. 17-21, 2007, pp. 1398-1404, Boston, MA, USA.

Gonthier, Laurent, et al, EN55015 Compliant 500W Dimmer with Low-Losses Symmetrical Switches, ST Microelectronics, Power Electronics and Applications, 2005 European Conference, pp. 1-9, Aug. 7, 2006, Dresden.

Green, Peter, A Ballast That Can Be Dimmed from a Domestic (Phase Cut) Dimmer, International Rectifier, IRPLCFL3 rev.b, pp. 1-12, Aug. 15, 2003, El Segundo, California, USA.

Hausman, Don, Real-Time Illumination Stability Systems for Trailing-Edge (Reverse Phase Control) Dimmers, Lutron Rtiss, Lutron Electronics Co, Dec. 2004, pp. 1-4, Coopersburg, PA, USA.

Lee, Stephen, et al, A Novel Electrode Power Profiler for Dimmable Ballasts Using DC Link Voltage and Switching Frequency Controls, IEEE Transactions on Power Electronics, vol. 19, No. 3, May 2004, pp. 847-833, City University of Hong Kong.

Engdahl, Tomi, Light Dimmer Circuits, 1997-2000, www.epanorama.net.

O'Rourke, Conan, et al, Dimming Electronic Ballasts, National Lighting Product Information Program, Specifier Reports, vol. 7, No. 3, Oct. 1999, pp. 1-24, Troy, NY, USA.

Supertex Inc, 56W Off-line LED Driver, 120VAC with PFC, 160V, 350mA Load, Dimmer Switch Compatible, DN-H05, pp. 1-20, Jun. 17, 2008, Sunnyvale, California, USA.

Lutron, Why Different Dimming Ranges, http://www.lutron.com/TechnicalDocumentLibrary/LutronBallastpg3.pdf, 2002, p. 3.

Wu, Tsai-Fu, et al, Single-Stage Electronic Ballast with Dimming Feature and Unity Power Factor, IEEE Transactions on Power Electronics, vol. 13, No. 3, May 1998, pp. 586-597.

Lutron, Flourescent Dimming Systems Technical Guide, copyright 2002, Why Different Dimming Ranges?, p. 3, Lutron Electronics Co., Inc., Coopersburg, PA, USA.

* cited by examiner

DIMMER OUTPUT EMULATION

CROSS-REFERENCE TO RELATED APPLICATION

This application claims the benefit under 35 U.S.C. §119 (e) and 37 C.F.R. §1.78 of U.S. Provisional Application No. 61/369,202, filed Jul. 30, 2010, and entitled "LED Lighting Methods and Apparatuses" and is incorporated by reference in its entirety.

BACKGROUND OF THE INVENTION

1. Field of the Invention

The present invention relates in general to the field of electronics, and more specifically to method and system for dimmer output emulation.

2. Description of the Related Art

Electronic systems utilize dimmers to direct modification of output power to a load. For example, in a lighting system, dimmers provide an input signal to a lighting system. The input signal represents a dimming level that causes the lighting system to adjust power delivered to a lamp, and, thus, depending on the dimming level, increase or decrease the brightness of the lamp. Many different types of dimmers exist. In general, dimmers use a digital or analog coded dimming signal that indicates a desired dimming level. For example, some analog based dimmers utilize a triode for alternating current ("triac") device to modulate a phase angle of each cycle of an alternating current ("AC") supply voltage. "Modulating the phase angle" of the supply voltage is also commonly referred to as "chopping" the supply voltage. Chopping the supply voltage causes the voltage supplied to a lighting system to rapidly turn "ON" and "OFF" thereby controlling the energy provided to a lighting system.

FIG. 1 depicts a lighting system 100 that includes a triac-based dimmer 102. FIG. 2 depicts exemplary voltage graphs 200 associated with the lighting system 100. Referring to FIGS. 1 and 2, the lighting system 100 receives an AC supply voltage $V_{SUPPLY}$ from voltage supply 104. The supply voltage $V_{SUPPLY}$ is, for example, a nominally 60 Hz/110 V line voltage in the United States of America or a nominally 50 Hz/220 V line voltage in Europe. Triac 106 acts as voltage-driven switch, and a gate terminal 108 of triac 106 controls current flow between the first terminal 110 and the second terminal 112. A gate voltage $V_G$ on the gate terminal 108 will cause the triac 106 to turn ON and current $i_{DIM}$ when the gate voltage $V_G$ reaches a firing threshold voltage value $V_F$ and a voltage potential exists across the first and second terminals 110 and 112. The dimmer output voltage $V_{\phi_DIM}$ is zero volts from the beginning of each of half cycles 202 and 204 at respective times $t_0$ and $t_2$ until the gate voltage $V_G$ reaches the firing threshold voltage value $V_F$. Dimmer output voltage $V_{\phi_DIM}$ represents the output voltage of dimmer 102. During timer period $T_{OFF}$, the dimmer 102 chops the supply voltage $V_{SUPPLY}$ so that the dimmer output voltage $V_{\phi_DIM}$ remains at zero volts during time period $T_{OFF}$. At time $t_1$, the gate voltage $V_G$ reaches the firing threshold value $V_F$, and triac 106 begins conducting. Once triac 106 turns ON, the dimmer voltage $V_{\phi_DIM}$ tracks the supply voltage $V_{SUPPLY}$ during time period $T_{ON}$. Once triac 106 turns ON, triac 106 continues to conduct current $i_{DIM}$ regardless of the value of the gate voltage $V_G$ as long as the current $i_{DIM}$ remains above a holding current value HC. The holding current value HC is a function of the physical characteristics of the triac 106. Once the current $i_{DIM}$ drops below the holding current value HC, i.e. $i_{DIM}$<HC, triac 106 turns OFF, i.e. stops conducting, until the gate voltage $V_G$ again reaches the firing threshold value $V_F$. The holding current value HC is generally low enough so that, ideally, the current $i_{DIM}$ drops below the holding current value HC when the supply voltage $V_{SUPPLY}$ is approximately zero volts near the end of the half cycle 202 at time $t_2$.

The variable resistor 114 in series with the parallel connected resistor 116 and capacitor 118 form a timing circuit 115 to control the time $t_1$ at which the gate voltage $V_G$ reaches the firing threshold value $V_F$. Increasing the resistance of variable resistor 114 increases the time $T_{OFF}$, and decreasing the resistance of variable resistor 114 decreases the time $T_{OFF}$. The resistance value of the variable resistor 114 effectively sets a dimming value for lamp 122. Diac 119 provides current flow into the gate terminal 108 of triac 106. The dimmer 102 also includes an inductor choke 120 to smooth the dimmer output voltage $V_{\phi_DIM}$. Triac-based dimmer 102 also includes a capacitor 121 connected across triac 106 and inductor 120 to reduce electro-magnetic interference.

Ideally, modulating the phase angle of the dimmer output voltage $V_{\phi_DIM}$ effectively turns the lamp 122 OFF during time period $T_{OFF}$ and ON during time period $T_{ON}$ for each half cycle of the supply voltage $V_{SUPPLY}$. Thus, ideally, the dimmer 102 effectively controls the average energy supplied to the lamp 122 in accordance with the dimmer output voltage $V_{\phi_DIM}$.

The triac-based dimmer 102 adequately functions in many circumstances. However, when the lamp 122 draws a small amount of current $i_{DIM}$, the current $i_{DIM}$ can prematurely drop below the holding current value HC before the supply voltage $V_{SUPPLY}$ reaches approximately zero volts. When the current $i_{DIM}$ prematurely drops below the holding current value HC, the dimmer 102 prematurely shuts down, and the dimmer voltage $V_{\phi_DIM}$ will prematurely drop to zero. When the dimmer voltage $V_{\phi_DIM}$ prematurely drops to zero, the dimmer voltage $V_{\phi_DIM}$ does not reflect the intended dimming value as set by the resistance value of variable resistor 114. For example, when the current $i_{DIM}$ drops below the holding current value HC at time $t_3$ for the dimmer voltage $V_{\phi_DIM}$ 206, the ON time period $T_{ON}$ prematurely ends at time earlier than $t_2$, such as time $t_3$, instead of ending at time $t_2$, thereby decreasing the amount of energy delivered to lamp 122. Thus, the energy delivered to lamp 122 will not match the dimming level corresponding to the dimmer voltage $V_{\phi_DIM}$.

SUMMARY OF THE INVENTION

In one embodiment of the present invention, an apparatus includes a dimmer output voltage emulator configured to cause a power converter interface circuit to generate an emulated dimmer output voltage. The emulated dimmer output voltage emulates part of a cycle of an alternating current dimmer output voltage of a dimmer.

In another embodiment of the present invention, a method includes causing a power converter interface circuit to generate an emulated dimmer output voltage. The emulated dimmer output voltage emulates part of a cycle of an alternating current dimmer output voltage of a dimmer.

In a further embodiment of the present invention, an apparatus includes a dimmer and a power converter interface circuit coupled to the dimmer. The apparatus further includes a dimmer output voltage emulator, coupled to the power converter interface circuit. The dimmer output voltage emulator is configured to cause a power converter interface circuit to generate an emulated dimmer output voltage. The emulated dimmer output voltage emulates part of a cycle of an alternating current dimmer output voltage of a dimmer. The apparatus further includes a power converter coupled to the dimmer output voltage emulator and a controller coupled to the dimmer output voltage emulator and the power converter. The controller is configured to control the power converter in accordance with the emulated dimmer output voltage.

In another embodiment of the present invention, an apparatus includes means for causing a power converter interface circuit to generate an emulated dimmer output voltage. The emulated dimmer output voltage emulates part of a cycle of an alternating current dimmer output voltage of a dimmer.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

In at least one embodiment, a lighting system includes a dimmer output voltage emulator to cause a power converter interface circuit to generate an emulated dimmer output voltage. In at least one embodiment, the emulated dimmer output voltage corresponds to an actual dimmer output voltage but is unaffected by non-idealities in the dimmer output voltage, such as premature shut-down of a triac-based dimmer. By generating an emulated dimmer output voltage, the energy delivered to a load, such as a lamp, corresponds to a dimming level setting.

In at least one embodiment, the power converter interface circuit interfaces with a triac-based dimmer circuit. In at least one embodiment, the dimmer output voltage emulator causes the power converter interface circuit to emulate the output voltage of the triac-based dimmer circuit after the triac in the triac-based dimmer begins conducting. In at least one embodiment, the lighting system draws too little current to allow the triac to conduct until a supply voltage reaches approximately zero. In at least one embodiment, the dimmer output voltage emulator effectively isolates the power converter interface circuit from the triac-based dimmer, and the emulated dimmer output voltage allows the lighting system to function in a normal mode that is equivalent to when the triac ideally continues to conduct until the supply voltage reaches approximately zero. In at least one embodiment, the dimmer output voltage emulator also causes the power converter interface circuit to appear as a low impedance to the triac-based dimmer circuit to allow timing circuitry in the dimmer circuit to reset and begin an operation for the next cycle of the supply voltage.

Figure 1:
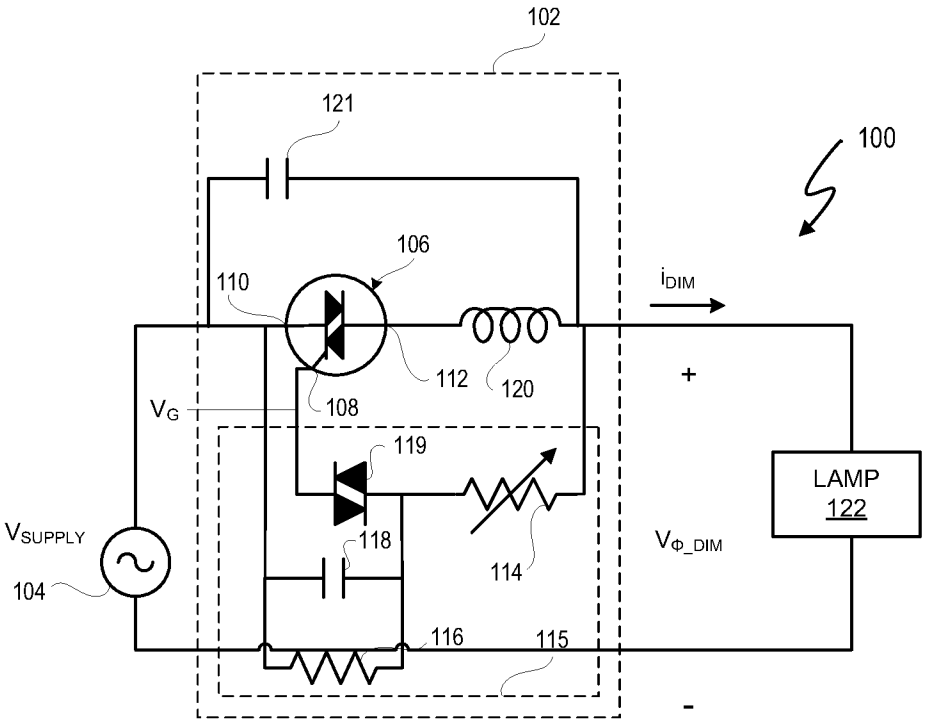
FIG. 1 (Prior Art)
FIG. 1 (labeled prior art) depicts a lighting system that includes a triac-based dimmer.
Figure 2:
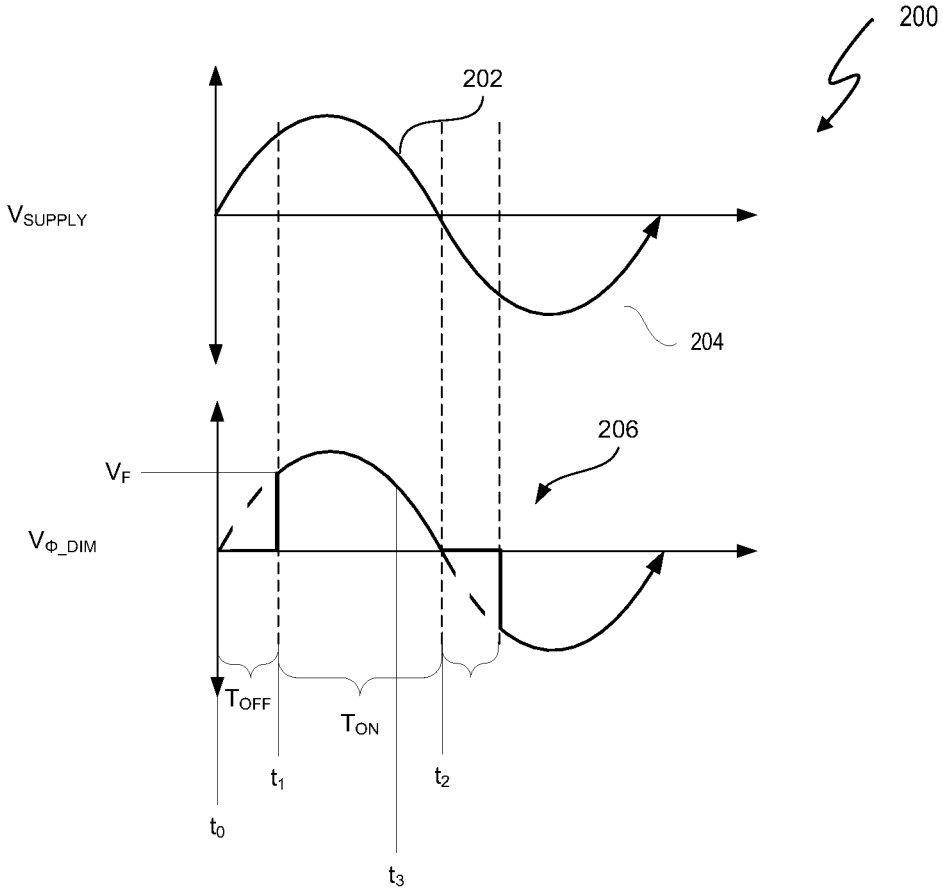
FIG. 2 (PRIOR ART)
FIG. 2 (labeled prior art) depicts exemplary voltage graphs associated with the lighting system of FIG. 1.
Figure 3:
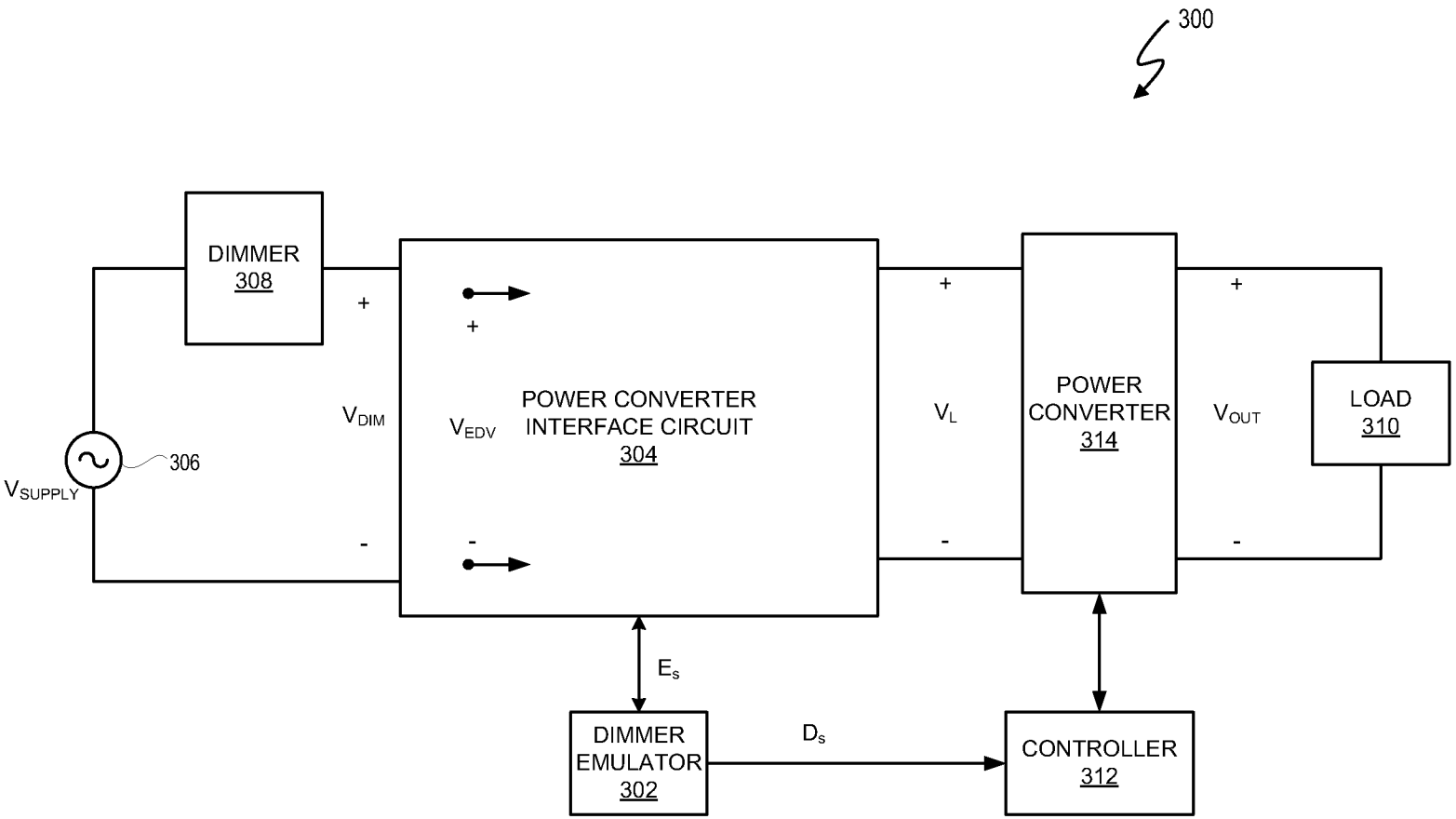
FIG. 3 depicts a lighting system having a dimmer output voltage emulator.

FIG. 3 depicts a lighting system 300 having a dimmer output voltage emulator 302 that is configured to cause a power converter interface circuit 304 to generate an emulated dimmer output voltage $V_{EDV}$. The voltage supply 306 generates a supply voltage $V_{SUPPLY}$, which in one embodiment is identical to the supply voltage generated by voltage supply 104 (FIG. 1). The dimmer 308 generates a dimmer voltage $V_{DIM}$ and provides the dimmer voltage $V_{DIM}$ to the power converter interface circuit 304. In at least one embodiment, the dimmer 308 is identical to triac-based dimmer 102 (FIG. 1). In at least one embodiment, the dimmer emulator 302 senses the dimmer voltage $V_{DIM}$ and generates an emulator signal $E_S$ that causes the power converter interface circuit 304 to generate an emulated dimmer output voltage $V_{EDV}$. The emulated dimmer output voltage $V_{EDV}$ functions as a dimmer output voltage. The power converter interface circuit 304 converts the emulated dimmer output voltage $V_{EDV}$ into a link voltage $V_L$ to power converter 314.

The dimmer emulator 302 also provides a dimmer information signal $D_S$ to controller 312. The dimmer information signal $D_S$ indicates how much energy power converter 314 should provide to load 310. For example, if dimmer signal $V_{DIM}$ indicates a 50% dimming level, then the dimmer information signal $D_S$ indicates a 50% dimming level. Controller 312 responds to the dimmer information signal $D_S$ and causes power converter 314 to provide 50% power to load 310. The particular generation of emulator signal $E_S$ and dimmer information signal $D_S$ are matters of design choice and, for example, depend on the particular respective designs of power converter interface circuit 304 and controller 312. In at least one embodiment, dimmer emulator 302 includes an analog-to-digital converter to convert the dimmer signal $V_{DIM}$ into a digital dimmer information signal $D_S$. In at least one embodiment, dimmer emulator 302 includes a timer that determines the phase delay of the dimmer signal $V_{DIM}$ and converts the phase delay into dimmer information signal $D_S$. In at least one embodiment, the emulator signal $E_S$ is a current that controls the emulated dimmer output voltage $V_{EDV}$. In at least one embodiment, emulator signal $E_S$ and dimmer signal information signal $D_S$ are two different signals. In at least one embodiment, emulator signal Es and dimmer information signal $D_S$ are the same signal. Load 310 can be any type of load. In at least one embodiment, load 310 includes one or more lamps, such as one or more light emitting diodes (LEDs). The particular type and design of controller 312 is a matter of design choice. An exemplary controller 312 is available from Cirrus Logic, Inc. having offices in Austin, Tex., USA. The particular type and design of power converter 314 is a matter of design choice. In at least one embodiment, power converter 314 is a switching power converter, such as a boost-type, buck-type, boost-buck-type, or Cúk-type switching power converter. In at least one embodiment, power converter 314 provides power factor correction and regulates the output voltage $V_{OUT}$ and/or current delivered to load 310. U.S. Pat. No. 7,719,246, entitled "Power Control System Using a Nonlinear Delta-Sigma Modulator with Nonlinear Power Conversion Process Modeling", filed Dec. 31, 2007, inventor John L. Melanson describes exemplary power converters and controllers.

Figure 4:
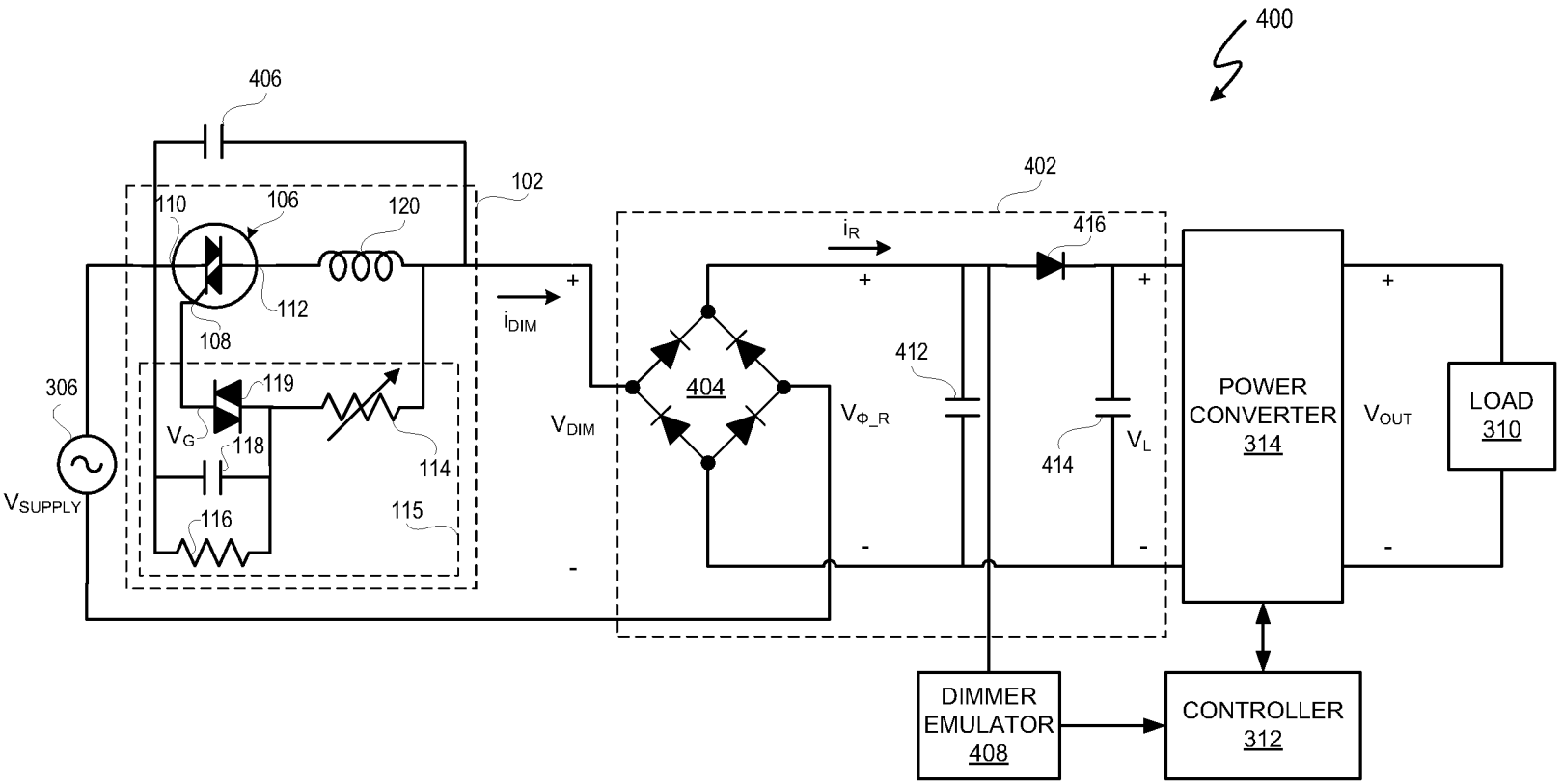
FIG. 4 depicts an embodiment of the lighting system of FIG. 3.
Figure 5:
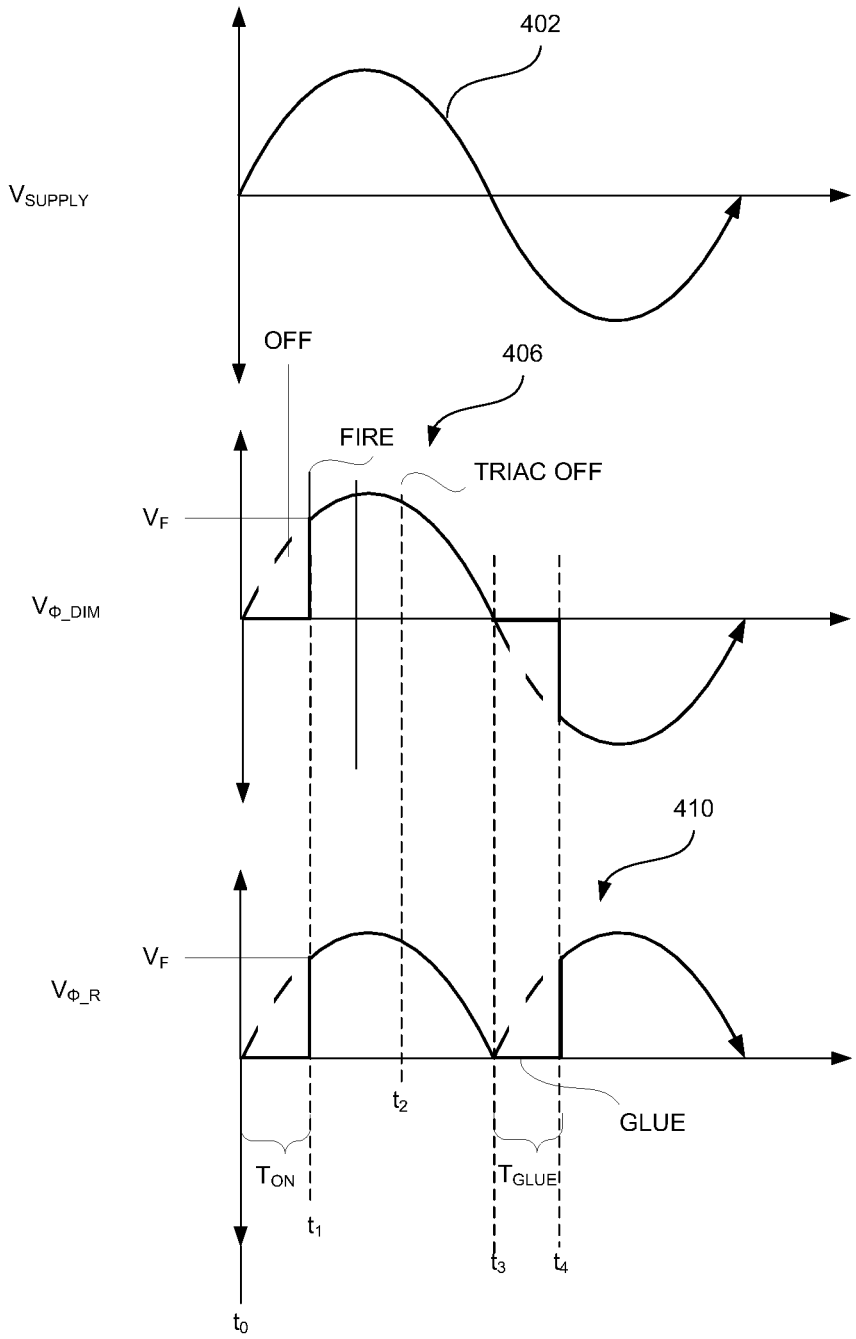
FIG. 5 depicts exemplary voltage graphs associated with the lighting system of FIG. 4.

FIG. 4 depicts lighting system 400, which represents one embodiment of lighting system 300. FIG. 5 depicts exemplary voltage graphs 500 associated with the lighting system 400. Voltage supply 306 provides supply voltage $V_{SUPPLY}$, and triac-based dimmer 102 generates a dimmer voltage $V_{\phi_DIM}$ as described in conjunction with FIG. 1. In the embodiment of FIG. 5, the triac 106 turns ON at time $t_1$ when the supply voltage $V_{SUPPLY}$ is at 45° and 225°. The power converter interface circuit 402, which represents one embodiment of power converter interface 304, includes a full-bridge diode rectifier 404 that rectifies the dimmer voltage $V_{\phi_DIM}$ to generate voltage $V_{\phi_R}$, while the triac 106 is ON between times $t_1$ and $t_2$. The voltage $V_{\phi_R}$ recharges capacitor 414. In at least one embodiment, the load 310 presents a low wattage load to power interface circuit 402. For example, in at least one embodiment, load 310 includes one or more low wattage lamps, such as 5-10 W light emitting diodes ("LEDs"). In this embodiment, load 310 draws a relatively small amount of current which causes the dimmer current $i_{DIM}$ to drop below the holding current value HC at time $t_2$. Thus, in the embodiment of FIG. 5, the current $i_{DIM}$ falls below the holding current value HC, and triac 106 turns OFF prematurely at time $t_2$. Conventionally, when triac 106 turns OFF at time $t_2$, triac 106 would chop the trailing edge of rectified voltage $V_{\phi_R}$ at time $t_2$. However, the dimmer emulator 408, which represents one embodiment of dimmer emulator 302, causes the power converter interface circuit 402 to emulate a continuous rectified voltage $V_{\phi_R}$.

When the triac 106 turns OFF, capacitor 406 maintains the voltage across triac 106 and inductor 120 low so that very little current is drawn from the timing circuit 115 during time period $T_{ON}$. In at least one embodiment, the current drawn from the timing circuit 115 is low enough to prevent the triac 106 from firing prior to the next phase cut ending time at time $t_4$. Capacitor 406 has a capacitance value of, for example, 100 nF.

In at least one embodiment, the supply voltage $V_{SUPPLY}$ is a sine wave. Thus, the ideal voltage $V_{\phi_R}$ during the ON period $T_{ON}$ is a portion of a sine wave. The voltage $V_{\phi_R}$ charges capacitor 412. A current $i_R$ that is proportional to the derivative of the voltage $V_{\phi_R}$ over time, i.e. $i_R \propto dV_{\phi_R}/dt$, and drawn from capacitor 412 will cause the voltage $V_{\phi_R}$ across capacitor 412 to emulate the dimmer output voltage $V_{DIM}$ that would occur if the dimmer current $i_{DIM}$ remained above the holding current value HC. Thus, when triac 106 turns OFF, the voltage $V_{\phi_R}$ becomes an emulated dimmer output voltage (emulated dimmer output voltage $V_{EDV}$ of FIG. 3). Accordingly, in at least one embodiment, the dimmer emulator 408 generates a current $i_R$ to cause power converter interface circuit 402 to generate voltage $V_{\phi_R}$ as the emulated dimmer output voltage $V_{EDV}$. When the dimmer emulator 408 generates a current $i_R$ to cause power converter interface circuit 402 to generate voltage $V_{\phi_R}$, voltage $V_{\phi_R}$ is referred to as the "emulated dimmer output voltage $V_{\phi_R}$".

When the triac 106 is turned ON, current $i_R$ charges link capacitor 414 through diode 416 as long as the voltage $V_{\phi_R}$ exceeds the link voltage $V_L$ by at least the forward-biased voltage (e.g. 0.7V) of diode 416. In at least one embodiment, link capacitor 414 has a large enough capacitance to provide an approximately constant link voltage $V_{LINK}$ to power converter 314. In at least one embodiment, the capacitance of capacitor 412 is 10 nF, and the capacitance of link capacitor 414 is 1.5 μF.

As the voltage $V_{\phi_R}$ decreases, the current $i_{DIM}$ decreases below the holding current value HC at time $t_2$, and the triac 106 turns OFF at time $t_2$. The dimmer emulator 408 then discharges capacitor 412 by drawing current $i_R$ from capacitor 412. During the time between $t_2$ and $t_3$, the dimmer emulator 408 draws current $i_R$ in proportion to $dV_{\phi_R}/dt$ so that, in at least one embodiment, the emulated dimmer output voltage $V_{\phi_R}$ emulates a decreasing sine wave. As the voltage $V_{\phi_R}$ approaches zero volts at time $t_3$, the dimmer emulator 408 draws sufficient current $i_R$ from capacitor 412 to hold the voltage $V_{\phi_R}$ low, i.e. approximately 0 volts, until the triac 106 turns ON again at time $t_4$. Holding the voltage $V_{\phi_R}$ low during the OFF period $T_{OFF}$ allows the timing circuitry 115 to reset and turn triac 106 ON at time $t_4$ during the next half cycle of the supply voltage $V_{SUPPLY}$.

The particular design of dimmer emulator 408 and the particular waveform of the emulated dimmer output voltage $V_{\phi_R}$ are matters of design choice. In at least one embodiment, the particular waveform of emulated dimmer output voltage $V_{\phi_R}$ is determined by the current $i_R$. In at least one embodiment, if the dimmer emulator 408 draws too much current $i_R$, capacitor 406 will discharge prior to a zero crossing at time $t_3$ of the supply voltage $V_{SUPPLY}$ and cause the firing of triac 106 to be out of sync with the zero crossing of supply voltage $V_{SUPPLY}$. If the firing of triac 106 is out of sync with the zero crossing of supply voltage $V_{SUPPLY}$, the phase cut of supply voltage $V_{SUPPLY}$ will occur at the wrong angle. In addition to erroneously modifying the phase cut timing of the supply voltage $V_{SUPPLY}$, drawing too much current from capacitor 406 can cause at least a second firing of triac 106 during a cycle of $V_{\phi_R}$. Multiple firings of triac 106 during a single cycle can cause flicker in a lamp of load 310 or cause instability in the triac-based dimmer 102. Because the bridge rectifier 404 prevents current from flowing from the power converter interface circuit 402 into triac-based dimmer 102, drawing too little current $i_R$ can cause the emulated dimmer output voltage $V_{\phi_R}$ to decrease too slowly to reach approximately 0V at time $t_3$. If the emulated dimmer output voltage $V_{\phi_R}$ does not reach approximately 0V at time $t_3$, dimmer emulator 408 may not properly hold the emulated dimmer output voltage $V_{\phi_R}$ at approximately 0V, which can also cause instability and flickering in a lamp of load 310.

Figure 6:
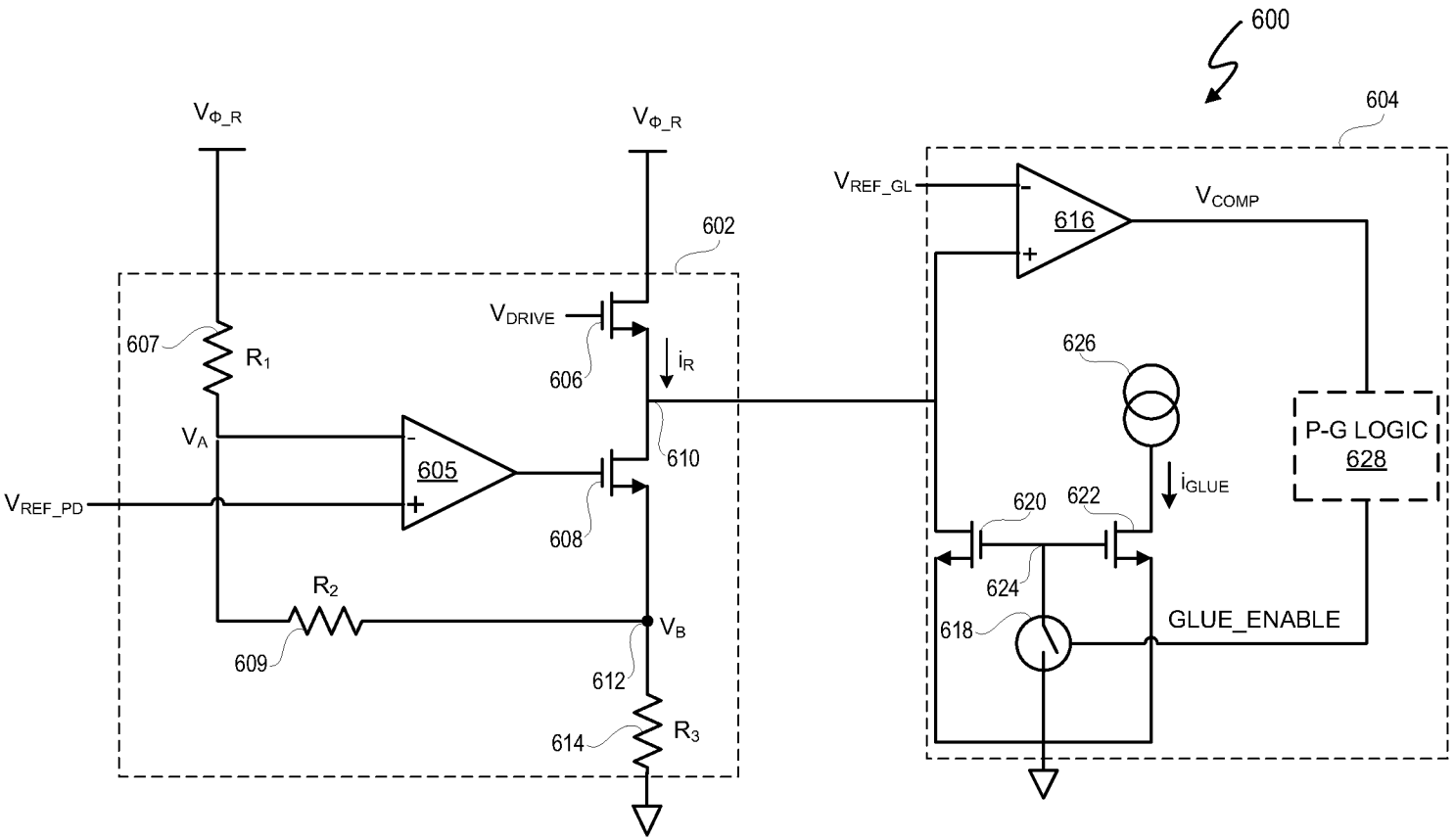
FIG. 6 depicts a dimmer emulator embodiment of the lighting system of FIG. 4.

FIG. 6 depicts a dimmer emulator 600, which represents one embodiment of dimmer emulator 408. Dimmer emulator 600 represents one embodiment of a current source that controls the current $i_R$. Dimmer emulator 600 includes a pull-down circuit 602 to pull-down current $i_R$ after the triac 106 (FIG. 4) turns OFF, and a hold or "glue" circuit 604 to hold the emulated dimmer output voltage $V_{\phi_R}$ to approximately 0V until the triac 106 fires in a next half-cycle of dimmer voltage $V_{DIM}$.

Figure 7:
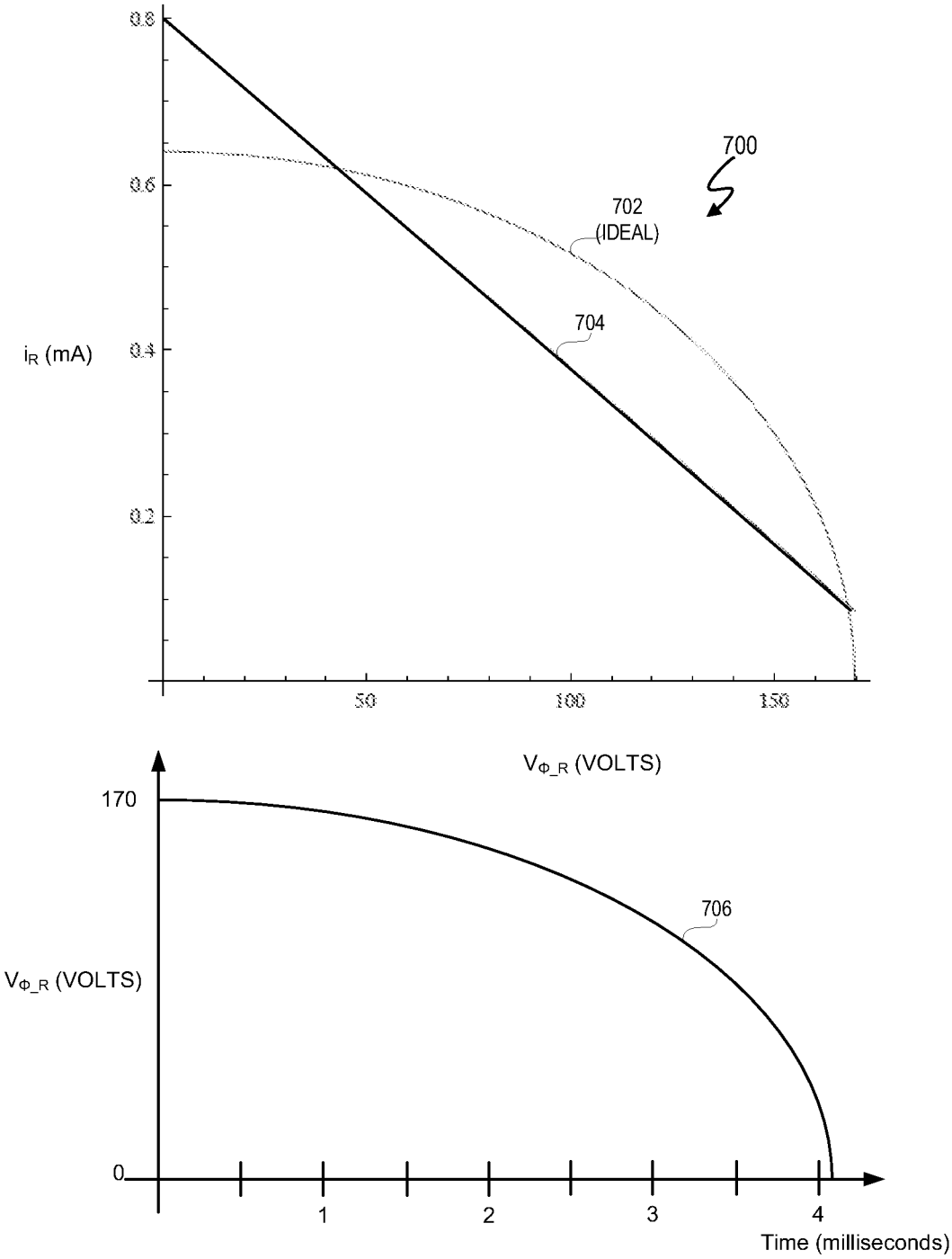
FIG. 7 depicts current-voltage and voltage-time graphs involving the dimmer emulator of FIG. 6.

FIG. 7 depicts current-voltage graphs 700 involving the emulated dimmer output voltage $V_{\phi_R}$, which is caused by an embodiment of pull-down circuit 602. Referring to FIGS. 6 and 7, since the supply voltage $V_{SUPPLY}$ is a cosine wave, and the current $i_R$ is directly related to the derivative of the emulated dimmer output voltage $V_{\phi_R}$, the ideal relationship between the current $i_R$ and the emulated dimmer output voltage $V_{\phi_R}$ for a half cycle of supply voltage $V_{SUPPLY}$ is a quarter sine wave 702. However, a linearly decreasing relationship 704 between current $i_R$ and emulated dimmer output voltage $V_{\phi_R}$ is a close approximation of the ideal waveform 702. The $i_R$ versus emulated dimmer output voltage $V_{\phi_R}$ relationship 704 causes the power converter interface circuit 402 to generate an oval emulated dimmer output voltage $V_{\phi_R}$ versus time graph 706, which is a close approximation to a phase cut supply voltage $V_{SUPPLY}$.

In general, the pull-down circuit 602 creates the linearly decreasing relationship 704 between current $i_R$ and emulated dimmer output voltage $V_{\phi_R}$. The pull-down circuit 602 includes an operational amplifier 605 which includes a non-inverting input terminal "+" to receive a pull-down reference voltage $V_{REF_PD}$. A feedback loop with voltage divider R1 and R2 between the emulated dimmer output voltage $V_{\Phi_R}$ terminal 605 and voltage $V_B$ at node 612 creates an inverse relationship between voltage $V_B$ and emulated dimmer output voltage $V_{\Phi_R}$. Thus, as the emulated dimmer output voltage $V_{\Phi_R}$ decreases, operational amplifier 605 drives the gate of n-channel metal oxide semiconductor field effect transistor (NMOSFET) 608 to increase the voltage $V_B$ so that the voltage $V_A$ at the inverting terminal "−" matches the reference voltage $V_{REF_PD}$ at the non-inverting terminal "+". Similarly, as the emulated dimmer output voltage $V_{\Phi_R}$ increases, operational amplifier 605 drives the gate of n-channel metal oxide semiconductor field effect transistor (NMOSFET) 608 to decrease the voltage $V_B$ so that the voltage $V_A$ at the inverting terminal "−" continues to match the reference voltage $V_{REF_PD}$ at the non-inverting terminal "+".

The voltage $V_{DRIVE}$ at the gate of NMOSFET 606 maintains NMOSFET in saturation mode. In at least one embodiment, voltage $V_{DRIVE}$ is +12V. The voltage $V_B$ across resistor 614 determines the value of current $i_R$, i.e. $i_R=V_B/R3$, and "R3" is the resistance value of resistor 614. Thus, current $i_R$ varies directly with voltage $V_B$ and, thus, varies inversely with emulated dimmer output voltage $V_{\Phi_R}$ as depicted by the linearly decreasing $i_R$ versus $V_{\Phi_R}$ relationship 704. From the topology of pull-down circuit 602, voltage $V_B$ is related to the reference voltage $V_{REF_PD}$ in accordance with Equation [1]:

$$V_B = V_{REF_PD} \cdot \frac{R1 + R2}{R1} - \frac{R2 \cdot V_{\Phi_R}}{R1} \quad [1]$$

R1 is the resistance value of resistor 607, and R2 is the resistance value of resistor 609. If R1>>R2, then the voltage $V_B$ is represented by Equation [1] [2]

$$V_B \approx V_{REF_PD} - \frac{R2 \cdot V_{\Phi_R}}{R1} \quad [2]$$

Since $i_R=V_B/R3$, if R1 is 10 Mohms, R2 is 42 kohms, and R3 is 1 kohm, in accordance with Equation [2], $i_R$ is represented by Equation [3]:

$$i_R \approx 0.8\left(1 - \frac{V_{\Phi_R}}{190}\right)\text{mA} \quad [3]$$

Once the pull-down circuit 602 lowers the emulated dimmer output voltage $V_{\Phi_R}$ to a glue down reference voltage $V_{REF_GL}$, the glue-down circuit 604 holds the emulated dimmer output voltage $V_{\Phi_R}$ at or below a threshold voltage, such as approximately 0V, until the triac 106 fires and raises the emulated dimmer output voltage $V_{\Phi_R}$. Comparator 616 of glue-down circuit 604 compares the emulated dimmer output voltage $V_{\Phi_R}$ with the glue-down reference voltage $V_{REF_GL}$. The particular value of the glue-down reference voltage $V_{REF_GL}$ is a matter of design choice. In at least one embodiment, voltage $V_{REF_GL}$ is set so that the glue-down circuit 604 holds the voltage $V_{\Phi_R}$ to approximately 0V when the voltage $V_{\Phi_R}$ approaches 0V. In at least one embodiment, the glue-down reference voltage $V_{REF_GL}$ is set to 5V. Since NMOSFET 606 operates in saturation mode, the voltage at node 610 is approximately equal to emulated dimmer output voltage $V_{\Phi_R}$. When emulated dimmer output voltage $V_{\Phi_R}$ is greater than the glue-down reference voltage $V_{REF_GL}$, the output voltage $V_{COMP}$ of comparator 616 is a logical 0. In at least one embodiment, the comparator output voltage $V_{COMP}$ is passed directly as signal GLUE_ENABLE to a control terminal of switch 618. Switch 618 can be any type of switch and is, for example, an NMOSFET. When the comparator output voltage $V_{COMP}$ is a logical 0, switch 618 is OFF, and NMOSFETs 620 and 622 are also OFF. When emulated dimmer output voltage $V_{\Phi_R}$ transitions from greater than to less than the glue-down reference voltage $V_{REF_GL}$, the comparator output voltage $V_{COMP}$ changes from a logical 0 to a logical 1. When the comparator output voltage $V_{COMP}$ is a logical 1, NMOSFETs 620 and 622 conduct. NMOSFETs 620 and 622 are configured as a current mirror sharing a common gate terminal 624. A current source 626 generates a glue current $i_{GLUE}$, which is mirrored through NMOSFET 620. In at least one embodiment, when emulated dimmer output voltage $V_{\Phi_R}$ is less than glue-down reference voltage $V_{REF_GL}$, current $i_R$ is approximately equal to the glue current $i_{GLUE}$. In at least one embodiment, the glue current $i_{GLUE}$ is set to a value large enough to hold the emulated dimmer output voltage $V_{\Phi_R}$ at approximately 0V until the triac 106 (FIG. 4) fires again. In at least one embodiment, the glue current $i_{GLUE}$ is at least as large as the holding current value HC of dimmer 102 (FIG. 4), such as 250 mA. Thus, the glue circuit 604 draws a steady state glue current $i_{GLUE}$ from the power converter interface circuit 402 to maintain the emulated dimmer output voltage $V_{\Phi_R}$ at or below a threshold voltage, such as approximately 0V, during a period of time from when the pull-down circuit 602 lowers the emulated dimmer output voltage $V_{\Phi_R}$ to the glue down reference voltage $V_{REF_GL}$ until the triac 106 fires and raises the emulated dimmer output voltage $V_{\Phi_R}$.

In at least one embodiment, the glue circuit 604 also includes pull-down, glue logic ("P-G logic") 628. The P-G logic 628 generates the signal GLUE_ENABLE to control conductivity of switch 618. The particular function(s) of P-G logic 628 are a matter of design choice. For example, in at least one embodiment, P-G logic 628 enables and disables the glue-down circuit 604. In at least one embodiment, to enable and disable the glue-down circuit 604, P-G logic 628 determines whether the dimmer output voltage $V_{\Phi_DIM}$ contains any phase cuts. If the dimmer output voltage $V_{\Phi_DIM}$ does not indicate any phase cuts, then the P-G logic 628 disables the glue down circuit 604 by generating the GLUE_ENABLE signal so that switch 618 does not conduct regardless of the value of comparator output voltage $V_{COMP}$. In at least one embodiment, P-G logic 628 includes a timer (not shown) that determines how often the comparator output voltage $V_{COMP}$ changes logical state. If the time between logical state changes is consistent with no phase cuts, P-G logic 628 disables the glue-down circuit 604.

Figure 8:
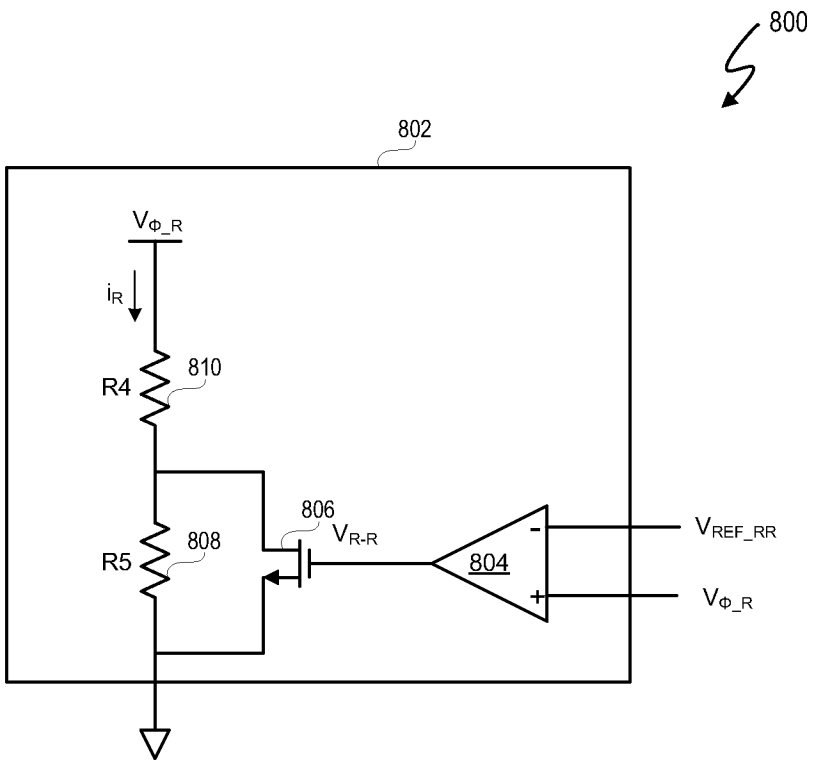
FIG. 8 depicts a dimmer emulator embodiment of the lighting system of FIG. 4.
Figure 9:
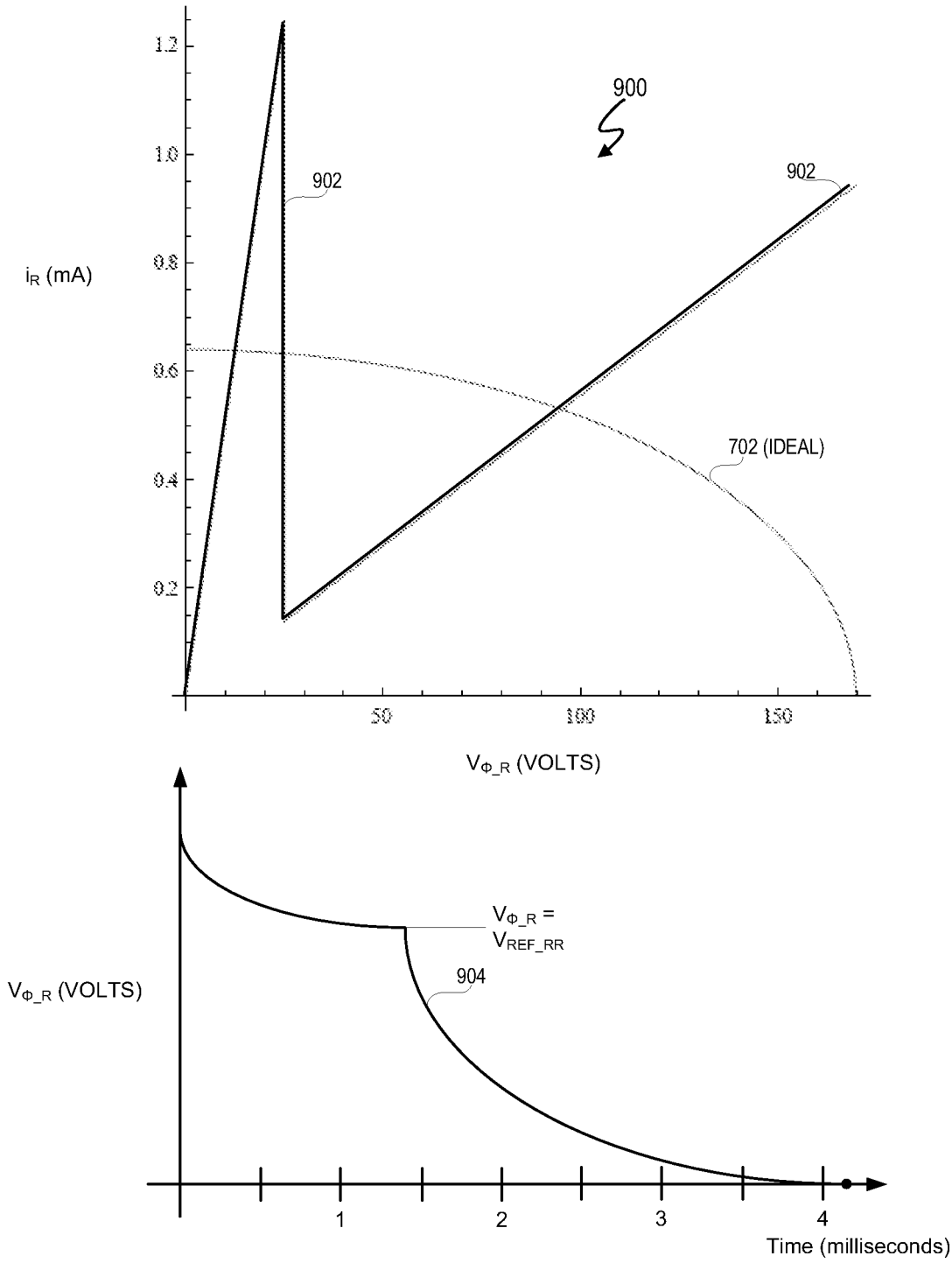
FIG. 9 depicts current-voltage and voltage-time graphs involving the dimmer emulator of FIG. 8.

Referring to FIG. 4, the dimmer emulator 408 can be implemented in any of a variety ways. For example, FIG. 8 depicts a dimmer emulator 800, which represents one embodiment of dimmer emulator 408. The dimmer emulator 800 includes a variable resistance circuit 802 that modifies the value of current $i_R$ based on the value emulated dimmer output voltage $V_{\Phi_R}$. FIG. 9 depicts current-voltage graphs 900 involving the emulated dimmer output voltage $V_{\Phi_R}$, which are caused by an embodiment of dimmer emulator 800. Referring to FIGS. 8 and 9, when emulated dimmer output voltage $V_{\Phi_R}$ is less than the reference voltage $V_{REF_RR}$, the output voltage $V_{R\text{-}R}$ of comparator 804 is a logical 0 and turns NMOSFET 806 OFF. When NMOSFET 806 is OFF, current $i_R$ flows through both resistor 808 and serially connected resistor 810. When the comparator output voltage $V_{R_R}$ is a logical 1, NMOSFET 806 turns ON and operates in saturation mode, thereby allowing current $i_R$ to bypass resistor 808.

The particular value of reference voltage $V_{REF_RR}$ and resistance values R4 and R5 of respective resistors 810 and 808 are matters of design choice. In the embodiment of current-voltage graphs 900, reference voltage $V_{REF_RR}$ is 25V, R4 is 20 kohms, and R5 is 180 kohms Thus, as depicted by the current $i_R$ versus emulated dimmer output voltage $V_{\phi_R}$ waveform 902, the current $i_R$ increases rapidly relative to increases in voltage $V_{\phi_R}$ in accordance with $i_R=V_{\phi_R}/(R4+R5)$ with increases in emulated dimmer output voltage $V_{\phi_R}$ when voltage $V_{\phi_R}$ is less than reference voltage $V_{REF_RR}$. When voltage $V_{\phi_R}$ is greater than reference voltage $V_{REF_RR}$, the current $i_R$ increases less rapidly relative to increases in voltage $V_{\phi_R}$.

The emulated dimmer output voltage $V_{\phi_R}$ versus time graph 904 depicts the emulated dimmer output voltage $V_{\phi_R}$ decreasing over time in a concave parabolic waveform while voltage $V_{\phi_R}$ is less than reference voltage $V_{REF_RR}$, and decreasing more rapidly over time when voltage $V_{\phi_R}$ is greater than reference voltage $V_{REF_RR}$. Thus, the emulated dimmer output voltage $V_{\phi_R}$ produced by dimmer emulator 408 causes the power converter interface 402 (FIG. 4) to emulate a dimmer output voltage, and the approximation of the emulated dimmer output voltage $V_{\phi_R}$ 904 is not as close of an approximation to the ideal $i_R$ versus emulated dimmer output voltage $V_{\phi_R}$ 704 produced by the current source of dimmer emulator 408.

Figure 10:
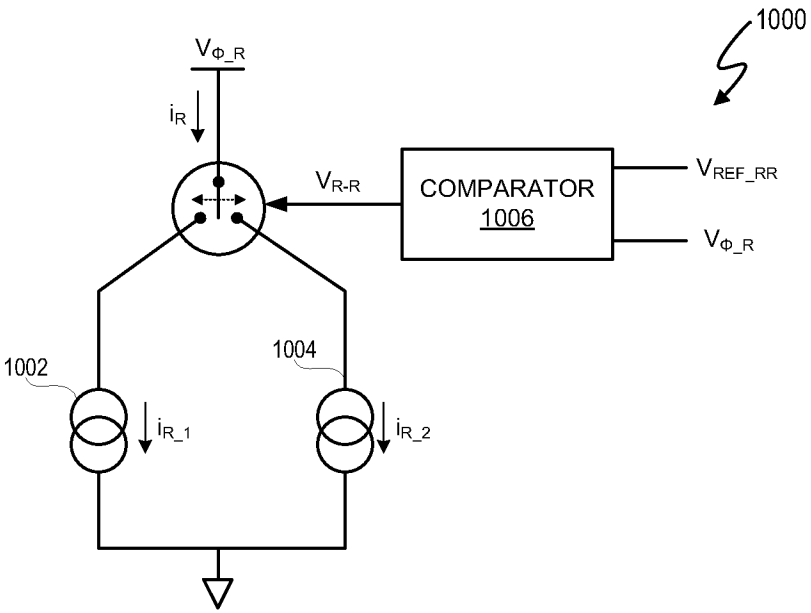
FIG. 10 depicts a dimmer emulator embodiment of the lighting system of FIG. 4.
Figure 11:
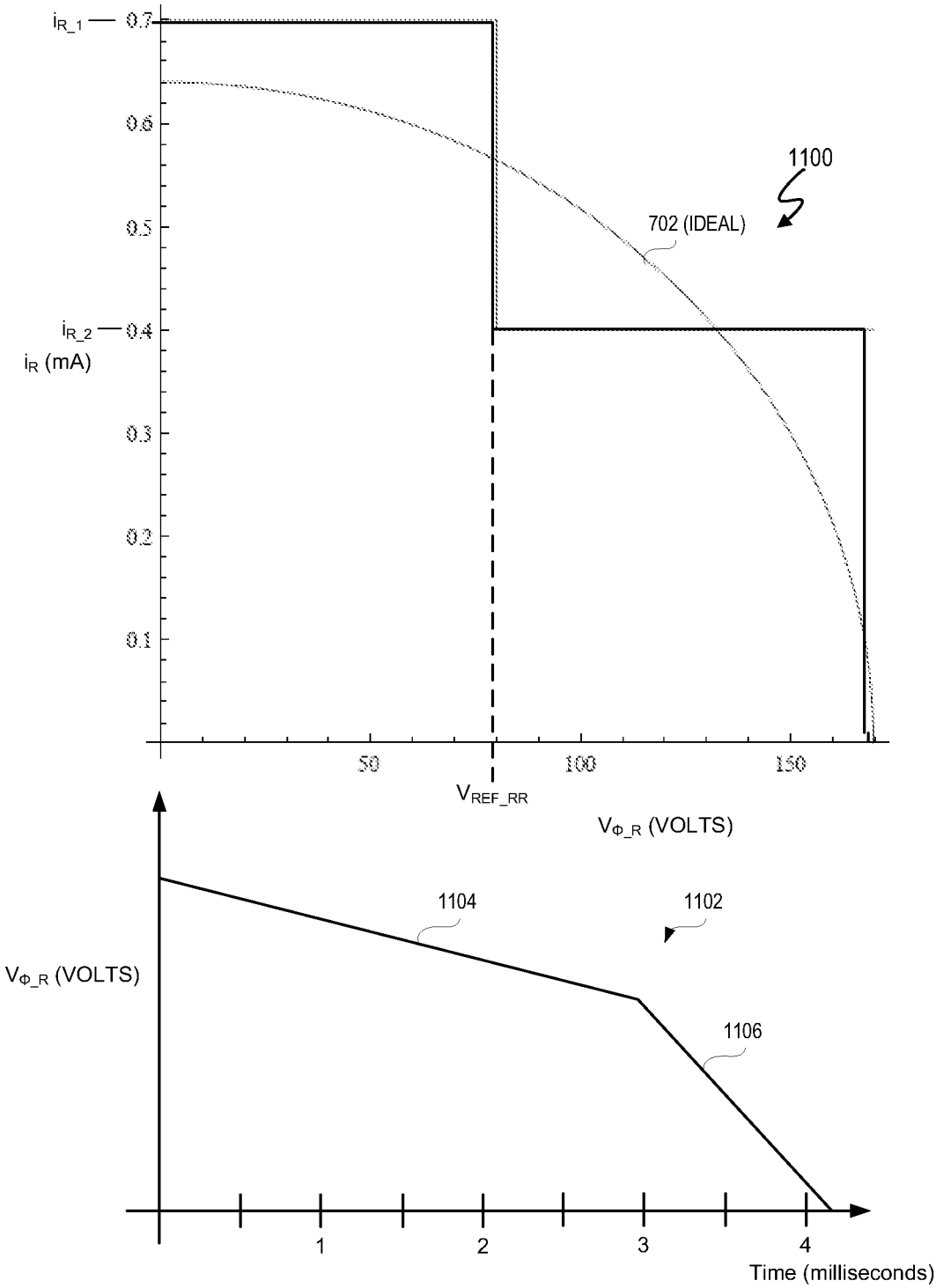
FIG. 11 depicts current-voltage and voltage-time graphs involving the dimmer emulator of FIG. 10.

FIG. 10 depicts a dimmer emulator 1000, which represents another embodiment of dimmer emulator 408. Dimmer emulator 1000 is a switching, constant current source that switches between two constant current sources 1002 and 1004 to cause power converter interface 402 to generate an emulated dimmer output voltage $V_{\phi_R}$. FIG. 11 depicts current-voltage graphs 1100 involving the emulated dimmer output voltage $V_{\phi_R}$, which are caused by an embodiment of dimmer emulator 1000. Comparator 1006 compares the reference voltage $V_{REF_RR}$ to emulated dimmer output voltage $V_{\phi_R}$. The particular value of reference voltage $V_{REF_RR}$ is a matter of design choice and is preferably set to a value that allows the dimmer emulator 1000 to most accurately approximate the ideal $i_R$ versus emulated dimmer output voltage $V_{\phi_R}$ 702. In the embodiment of graphs 1100, the reference voltage $V_{REF_RR}$ is 80V. When the emulated dimmer output voltage $V_{\phi_R}$ is less than the reference voltage $V_{REF_RR}$, comparator 1006 applies a logical 0 output signal to a control terminal of switch 1008 so that current $i_R$ equals the constant current $i_{R_1}$ generated by constant current source 1002. The particular value of the constant current $i_{R_1}$ generated by constant current source 1002 is a matter of design choice. In the embodiment of graphs 1100, $i_{R_1}=i_R=0.7$ mA when emulated dimmer output voltage $V_{\phi_R}$ is less than reference voltage $V_{REF_RR}$.

When the emulated dimmer output voltage $V_{\phi_R}$ is greater than the reference voltage $V_{REF_RR}$, comparator 1006 applies a logical 1 output signal to a control terminal of switch 1008 so that current $i_R$ equals the constant current $i_{R_2}$ generated by constant current source 1004. The particular value of the constant current $i_{R_2}$ generated by constant current source 1004 is a matter of design choice. In the embodiment of graphs 1100, $i_{R_2}=i_R=0.4$ mA when emulated dimmer output voltage $V_{\phi_R}$ is greater than reference voltage $V_{REF_RR}$. The constant currents $i_{R_1}$ and $i_{R_2}$ are preferably set to values that most accurately cause the dimmer emulator 1000 to approximate the ideal $i_R$ versus emulated dimmer output voltage $V_{\phi_R}$ 702. The emulated dimmer output voltage $V_{\phi_R}$ versus time graph 1102 depicts the emulated dimmer output voltage $V_{\phi_R}$ decreasing over time in multiple linear segments 1104 and 1106. Segments 1104 and 1106 of emulated dimmer output voltage $V_{\phi_R}$ each have a unique slope. Additionally, in other embodiments, the number of constant current sources in dimmer emulator 1000 can be increased to improve the approximation of emulated dimmer output voltage $V_{\phi_R}$.

Figure 12:
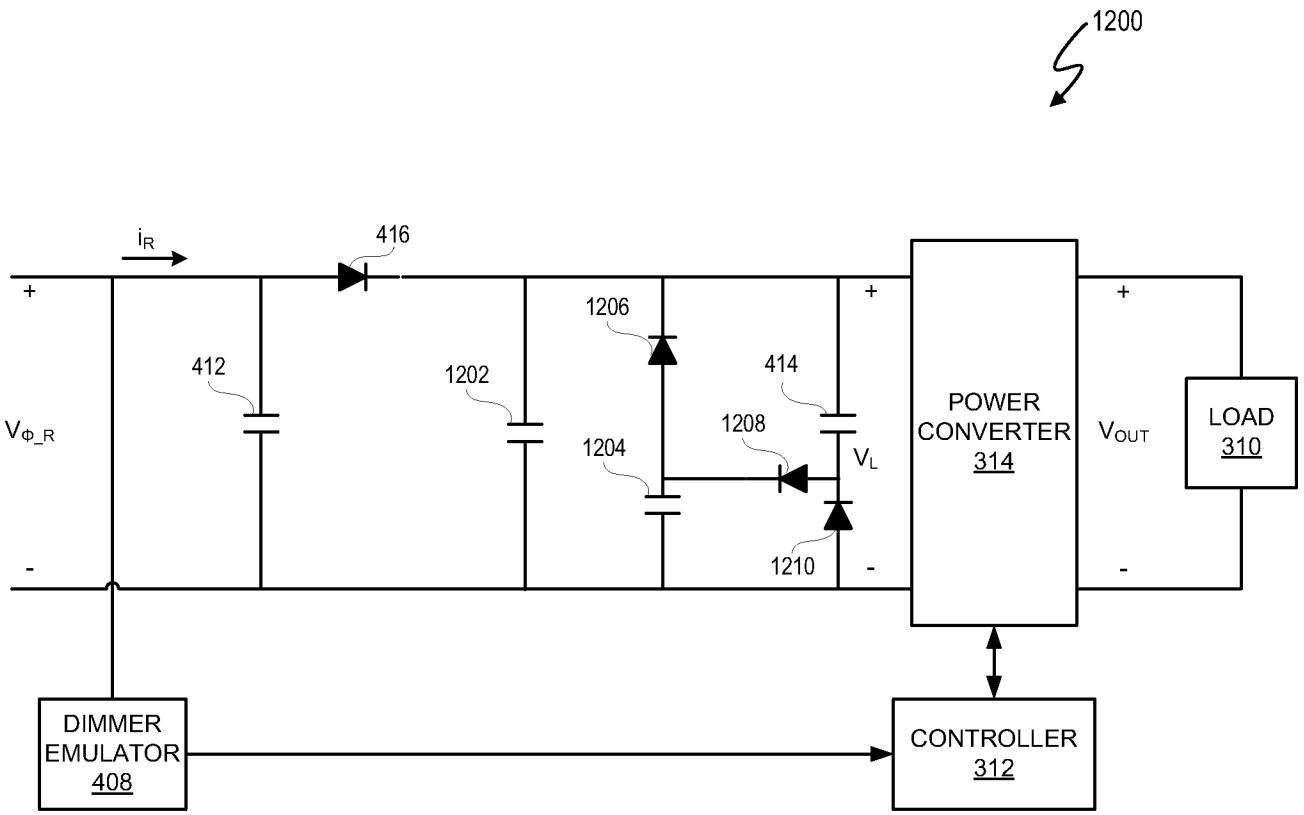
FIG. 12 depicts an embodiment of the lighting system of FIG. 3 with additional link voltage capacitors.

FIG. 12 depicts a lighting system 1200 that includes additional capacitors 1202 and 1204 to, for example, improve power factor correction. In at least one embodiment, the input circuitry to capacitor 412 is identical to the input circuitry of lighting system 400 to capacitor 412. In at least one embodiment, diodes 1206, 1208, and 1210 restrict the direction of current flow so that capacitor 1202 initiates the firing of triac 106 (FIG. 4) and capacitors 1204 and 412 hold the link voltage $V_L$ for each cycle of emulated dimmer output voltage $V_{\phi_R}$. Capacitors 1202 is recharged on a low cycle of emulated dimmer output voltage $V_{\phi_R}$, and capacitor 1204 is recharged close to the peak of emulated dimmer output voltage $V_{\phi_R}$.

Thus, a lighting system includes a dimmer output voltage emulator to cause a power converter interface circuit to generate an emulated dimmer output voltage.

Although embodiments have been described in detail, it should be understood that various changes, substitutions, and alterations can be made hereto without departing from the spirit and scope of the invention as defined by the appended claims.

What is claimed is:

1. An apparatus comprising:

a dimmer output voltage emulator configured to cause a power converter interface circuit to draw current from a capacitor in the power converter interface during a period of time when a dimmer coupled to the power converter interface circuit is non-conducting to generate an emulated dimmer output voltage, wherein the emulated dimmer output voltage emulates part of a cycle of a non-zero alternating current dimmer output voltage of the dimmer after a triac of the dimmer prematurely stops conducting that would occur if the triac continued conducting during the part of the cycle.

2. The apparatus of claim 1 wherein the emulated dimmer output voltage is generally decreasing over time during the emulated part of the dimmer output voltage cycle.

3. The apparatus of claim 1 wherein the emulated dimmer output voltage comprises multiple linear segments each having a unique slope.

4. The apparatus of claim 1 wherein the emulated dimmer output voltage comprises a concave parabolic waveform.

5. The apparatus of claim 1 wherein the dimmer output voltage emulator is further configured to provide current that interacts with components of the power interface circuit to provide the emulated dimmer output voltage.

6. The apparatus of claim 1 wherein the dimmer output voltage emulator comprises a pull-down circuit to pull-down current of the power converter interface circuit and generally decrease the emulated dimmer output voltage during a first period of time and a glue circuit to maintain the emulated dimmer output voltage below a threshold value during a second period of time.

7. The apparatus of claim 6 wherein the glue circuit provides a steady state current draw from the power converter interface circuit to maintain the emulated dimmer output voltage below the threshold value during the second period of time.

8. The apparatus of claim 6 wherein the first period of time begins when a triac of a triac-based dimmer circuit ceases conducting during a cycle of an AC supply voltage, the second period of time begins when the supply voltage is below the threshold voltage, the first period ends when the second period begins, and the second period ends when the supply voltage begins to increase.

9. A method comprising:

causing a power converter interface circuit to draw current from a capacitor in the power converter interface during a period of time when a dimmer coupled to the power converter interface circuit is non-conducting to generate an emulated dimmer output voltage, wherein the emulated dimmer output voltage emulates part of a cycle of a non-zero alternating current dimmer output voltage of the dimmer after a triac of the dimmer prematurely stops conducting that would occur if the triac continued conducting during the part of the cycle.

10. The method of claim 9 wherein causing the power converter interface circuit to generate an emulated dimmer output voltage comprises generally decreasing the emulated dimmer output voltage over time during the emulated part of the dimmer output voltage cycle.

11. The method of claim 9 wherein causing the power converter interface circuit to generate an emulated dimmer output voltage causing the power converter interface circuit to generate the emulated dimmer output voltage to include multiple linear segments each having a unique slope.

12. The method of claim 9 wherein causing the power converter interface circuit to generate an emulated dimmer output voltage causing the power converter interface circuit to generate the emulated dimmer output voltage comprises generating the emulated dimmer output voltage to include a convex parabolic waveform.

13. The method of claim 9 further comprising:

providing current that interacts with components of the power interface circuit to provide the emulated dimmer output voltage.

14. The method of claim 9 further comprising:

pulling-down current of the power converter interface circuit to generally decrease the emulated dimmer output voltage during a first period of time; and maintaining the emulated dimmer output voltage below a threshold value during a second period of time.

15. The method of claim 14 further comprising:

drawing a steady state current from the power converter interface circuit to maintain the emulated dimmer output voltage below the threshold value during the second period of time.

16. The method of claim 14 wherein the first period of time begins when a triac of a triac-based dimmer circuit ceases conducting during a cycle of an AC supply voltage, the second period of time begins when the supply voltage is below the threshold voltage, the first period ends when the second period begins, and the second period ends when the supply voltage begins to increase.

17. The method of claim 9 further comprising:

generating an emulated dimmer output voltage in a power converter interface circuit, wherein the emulated dimmer output voltage emulates part of a cycle of an alternating current dimmer output voltage of the dimmer.

18. An apparatus comprising:

a dimmer;

a power converter interface circuit coupled to the dimmer;

a dimmer output voltage emulator, coupled to the power converter interface circuit, wherein (i) the dimmer output voltage emulator is configured to cause the power converter interface circuit to draw current from a capacitor in the power converter interface during a period of time when the dimmer coupled to the power converter interface circuit is non-conducting to generate an emulated dimmer output voltage and (ii) the emulated dimmer output voltage emulates part of a cycle of an alternating current dimmer output voltage of the dimmer;

a power converter coupled to the dimmer output voltage emulator; and a controller coupled to the dimmer output voltage emulator and the power converter, wherein the controller is configured to control the power converter in accordance with the emulated dimmer output voltage.

19. The apparatus of claim 18 wherein:

the dimmer comprises a triac-based dimmer; and the power converter is a switching power converter.

20. An apparatus comprising:

means for causing a power converter interface circuit to draw current from a capacitor in the power converter interface during a period of time when a dimmer coupled to the power converter interface circuit is non-conducting to generate an emulated dimmer output voltage, wherein the emulated dimmer output voltage emulates part of a cycle of a non-zero alternating current dimmer output voltage of the dimmer after a triac of the dimmer prematurely stops conducting that would occur if the triac continued conducting during the part of the cycle.

21. The apparatus of claim 18 wherein the emulated dimmer output voltage emulates part of a cycle of a non-zero portion of the alternating current dimmer output voltage of the dimmer after a triac of the dimmer prematurely stops conducting that would occur if the triac continued conducting during the part of the cycle.

* * * * *